US009851185B2

(12) United States Patent
Bartolini

(10) Patent No.: US 9,851,185 B2
(45) Date of Patent: Dec. 26, 2017

(54) TARGET

(71) Applicant: COMINEL S.R.L., Conselice (RA) (IT)

(72) Inventor: Devis Bartolini, Lugo (IT)

(73) Assignee: COMINEL S.R.L., Conselice (RA) (IT)

( * ) Notice: Subject to any disclaimer, the term of this patent is extended or adjusted under 35 U.S.C. 154(b) by 0 days.

(21) Appl. No.: 15/335,883

(22) Filed: Oct. 27, 2016

(65) Prior Publication Data

US 2017/0284777 A1 Oct. 5, 2017

(30) Foreign Application Priority Data

Mar. 30, 2016 (IT) ..... 202016000032524

(51) Int. Cl.
*F41J 9/16* (2006.01)
*F41J 9/08* (2006.01)
*F41J 5/24* (2006.01)

(52) U.S. Cl.
CPC . *F41J 9/08* (2013.01); *F41J 5/24* (2013.01); *F41J 9/16* (2013.01)

(58) Field of Classification Search
CPC ..... F41J 9/16
USPC ..... 273/362–365
See application file for complete search history.

(56) References Cited

U.S. PATENT DOCUMENTS 2,106,655 A * 1/1938 Pollard ..... F41J 9/165 273/365
2,250,252 A * 7/1941 Bingham, Jr. ..... F41J 9/16 273/362
3,169,767 A * 2/1965 Bingham, Jr. ..... F41J 9/16 273/362
3,176,988 A * 4/1965 De Ferdinando ..... F41J 9/16 124/42
4,133,532 A * 1/1979 Lante-Montefeltro Della Rovere ..... F41J 9/16 273/364
4,206,919 A * 6/1980 Della Rovere ..... F41J 9/16 273/364
4,274,636 A * 6/1981 Lante-Montefeltro .... F41J 9/16 273/365
4,335,882 A * 6/1982 Della Rovere ..... F41J 9/16 273/363
4,352,496 A * 10/1982 Lanti-Montefeltro Della Rovere ..... F41J 9/16 273/363
4,433,842 A * 2/1984 Bertini ..... F41J 9/16 273/363

(Continued)

*Primary Examiner* — Mark Graham
(74) *Attorney, Agent, or Firm* — Abelman, Frayne & Schwab

(57) ABSTRACT

Target for helice target shooting comprising a helical body and a center piece that are snap-coupled together; the helical body comprising a cylindrical annular portion that extends according to a central axis (A) and is provided, peripherally, of at least one pair of mushroom-shaped projections so configured as to couple with the center piece in correspondence of respective peripheral seats; the annular portion having crack nucleation means suitable to facilitate the fracture, in use, by at least one shot.

10 Claims, 3 Drawing Sheets

(56) References Cited

U.S. PATENT DOCUMENTS

| | | | | |
|---|---|---|---|---|
| 5,389,142 | A * | 2/1995 | Moore | C04B 28/26<br>106/205.9 |
| 5,397,132 | A * | 3/1995 | Maryska | F41J 1/01<br>273/363 |
| 2004/0155408 | A1 * | 8/2004 | Ringtved | F41J 9/16<br>273/362 |

* cited by examiner

TARGET

CROSS-REFERENCE TO RELATED APPLICATIONS

This application claims the benefit of priority under 35 U.S.C. 119 to Italian Patent Application No. 202016000032524, filed Mar. 30, 2016, which is hereby incorporated by reference.

TECHNICAL FIELD OF THE INVENTION

The present invention relates to a target. In particular, the present invention relates to a target for helice shooting. In more detail, the present invention relates to a target for helice shooting provided with a helice and a removable witness cap.

BACKGROUND TO THE INVENTION

In the clay target shooting the TRAP is well known, wherein you shoot at a series of clay targets exiting from a box launcher. The shooter, who usually has a double shot firearm, knows the height and direction of the targets, that are launched from the box launcher always in the same way. The ability of the shooter is to intercept each target, taking into account that the time between two targets launches is variable. Usually, there are two box launchers, each one launching targets on trajectories that are at different height from the ground. The targets can have different shapes according to the type of trajectory they shall trace in the shooting area.

The trajectory of the axially symmetrical clays targets is usually quite predictable by the most experienced shooters; thus, the axially symmetrical clays have been replaced by flying targets so shaped as to trace more unpredictable trajectories, in order to make hitting the target more challenging. To this end, in the '60s a target, commonly called "helice", has been designed and constructed; it comprises a central body made of flexible plastic and a helical body, provided with two opposite blades and made of rigid plastic. This kind of targets are used in the discipline called "electrocibles". The central body of the target, usually named as "witness cap", is shaped similarly to the convex surface of a clay target. Therefore, the witness cap is connected in a snap-like manner to the helical body, to be detachable from that, which acts as a support of the same witness cap. In some cases, the helical (or finned) body has mushroom-shaped pins, which couple with housings provided in the peripheral part of the witness cap. It should be taken into account the fact that the material of which the witness cap is made is flexible; this means that, when hit by projectiles, it does not break, namely it elastically absorbs the energy of the projectiles, thus receiving a power contribution which influences, although in a limited manner, the motion thereof, given its aerodynamic structure.

Hitting the target is very challenging as the helice is flung quickly and at a small distance from the ground, so that it can skim over the ground zigzagging right and left, and then rises with the wind, making sudden and unpredictable swerves, similarly to the pigeons used in the past as moving targets. It should be noted that, according to the rules of this shooting discipline, the target is considered regularly hit only if the witness cap is completely dislodged from the finned body and lands within a given fenced area called ring. Otherwise, the shot is not considered valid. It is clearly understood that the hit received by the target by means of at least one projectile from a group (of spherical projectiles) must cause the fracture of the target and, in particular, of the helical body, thus the definitive separation of the witness cap from the helical body. If this does not happen, a portion of the helical body might remain connected to the witness cap, and the witness cap therefore falls within the ring together with helical body fragments, and this does not constitute a valid shot, i.e. the shooter does not score points. Therefore, the impossibility to guarantee the complete separation of the helical body fragments from the witness cap constitutes an additional risk variable that can compromise the shooter's performance without reason. Among the causes therefor, just by way of non-limiting example, there is the action of the wind, which could carry the witness cap outside the ring provided as given area to increase the score in the shooting competitions. Obviously, the above mentioned displacement outside the ring is also facilitated by the contribution to the rotation made by the set witness cap-helical body fragments, induced by the additional eccentric thrust transmitted by the shots hitting the target. This additional rotation adds aerodynamic lift to the blades of the helical body, resulting in an uncontrolled movement of the target.

In view of the above description, the uncontrolled movement induced by any helical body fragments still attached to the witness cap after the projectile shot can produce a particularly negative result due to the impossibility of controlling the witness cap falling trajectory once the target has been shot. Hence, all the efforts of the shooter to train for the physical and mental competition, can be frustrated.

In view of the above description it would be desirable to have available a target that, in addition to limiting and possibly to overcoming the drawbacks of the prior art, defines a new standard for this kind of targets in the "electocibles" discipline.

SUMMARY OF THE INVENTION

The present invention relates to a target. In particular, the present invention relates to a target for helice shooting. In more detail, the present invention relates to a target for helice shooting provided with a helice and a removable witness cap.

The object of the present invention is to provide a target that is simple and economical to be constructed and solves the above mentioned drawbacks.

According to the present invention a target is provided equipped with a helical body that can be easily fractured, whose main characteristics will be described in at least one of the appended claims.

BRIEF DESCRIPTION OF DRAWINGS

Further characteristics and advantages of the target according to the present invention will be more apparent from the description below, set forth with reference to the attached drawings, that illustrate some non-limiting examples of embodiment, where identical or corresponding parts are identified by the same reference numbers. In particular.

DETAILED DESCRIPTION OF THE INVENTION

Figure 1:
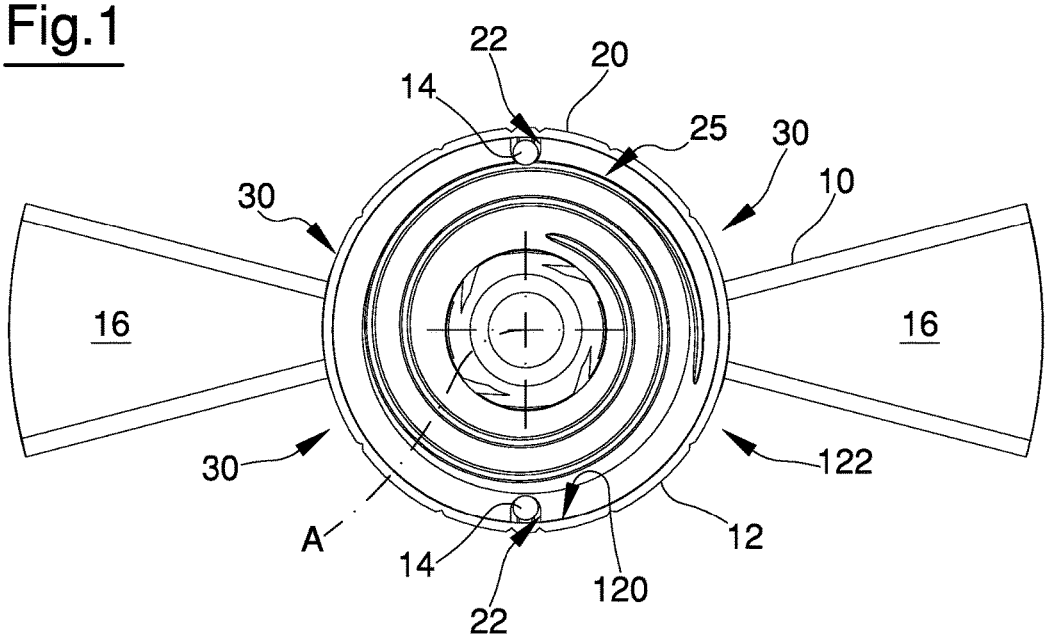
FIG. 1 is a plan view of a target according to this invention.
Figure 4:
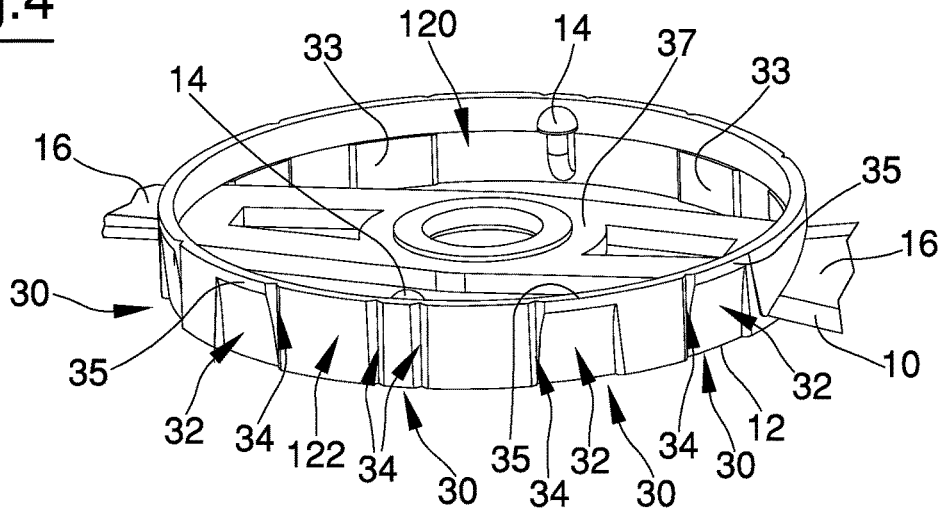
FIGS. 4 and 5 are two schematic perspective views from the bottom of FIG. 1 in enlarged scale and with some parts removed for the sake of clarity.

In FIG. 1, number 1 indicates, in its entirety, a target for the discipline of "electrocibles". This target comprises a helical body 10, made of rigid plastic, and a witness cap 20, made of flexible plastic, that are snap-coupled together. With particular reference to FIG. 4, the helical body 10 comprises a cylindrical annular portion 12 that extends according to a central axis A, from which a pair of helice blades 16 radially extend. The central portion 12 has a given height, is axially delimited by an inner face 120 and by an outer face 122 and is peripherally provided with at least one pair of mushroom-shaped projections 14, so configured as to be engaged by (and therefore to snap-couple with) the witness cap 20 in correspondence of respective peripheral seats 22. The mushroom-shaped projections 14 are two, and are diametrically opposite in FIG. 4, without however limiting the scope of the present invention.

Figure 2:
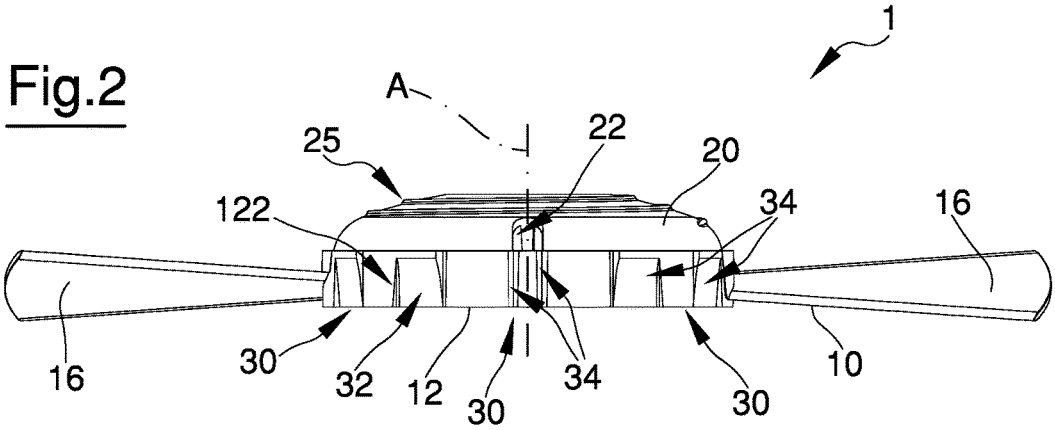
FIG. 2 is a side elevation view of FIG. 1.
Figure 3:
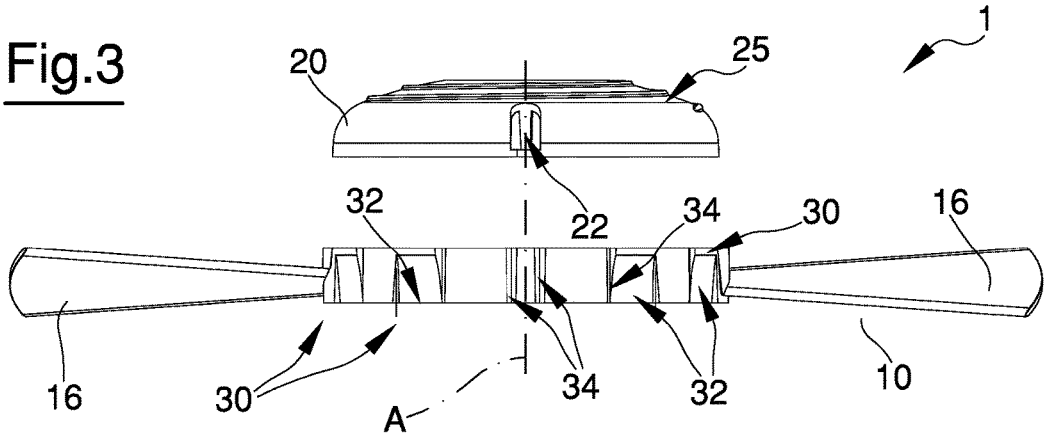
FIG. 3 is an exploded view of FIG. 2.

With particular reference to FIGS. 1-3, the witness cap 20 has a helical spiral 25 on a respective convex upper face.

With reference to FIG. 4 again, the annular portion 12 has a plurality of crack nucleation elements 30 for the fracture of the target 1, provided peripherally in the annular portion 12 in order to facilitate the breakage of the helical body 10 when, in use, the helical body 10 is hit by at least one projectile of a group of projectiles.

The crack nucleation elements may be actuated in several manners, as it will be described below. One of these elements is shaped similarly to a first groove 34, with triangular cross-section advantageously directed like the central axis A, as shown in FIG. 4, without however limiting the scope of the present invention. The annular portion 12 may also have a plurality of first grooves 34, uniformly distributed around the central axis A on the inner face 120 of the annular portion 12.

Figure 5:
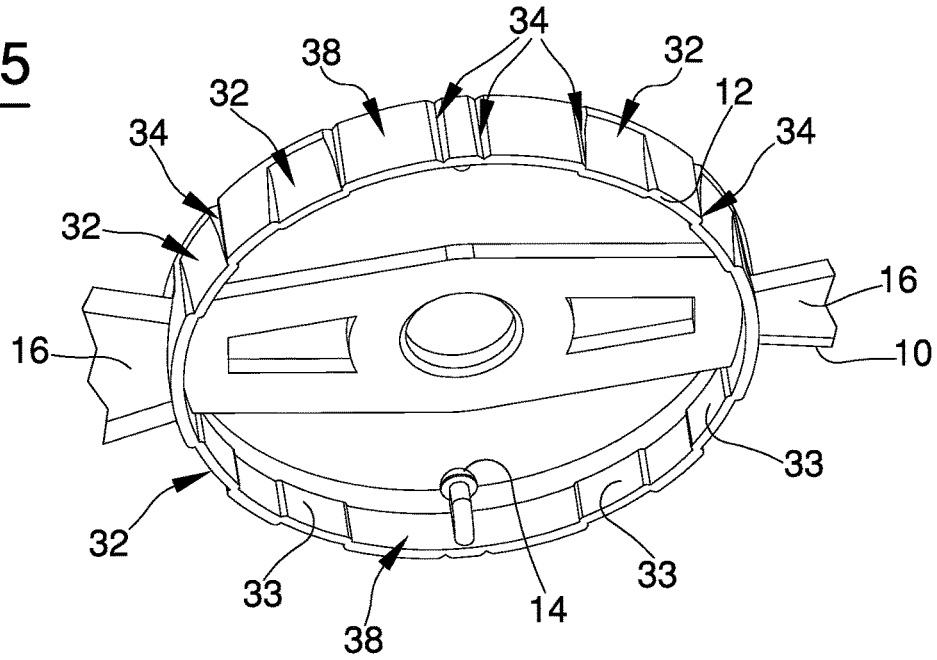

With reference to FIG. 2, the annular portion 12 may have a plurality of second grooves 32 delimited by a quadrangular profile, and in particular by a substantially trapezoidal profile. These second grooves are provided in the respective outer face 122 and are uniformly distributed around the central axis A. Each second groove 32 is delimited, at the top in FIG. 4, by a cylindrical edge 35. To each second groove 32 an impression 33 corresponds, that is provided on the inner face 120 and gives the central portion 12 a step-shaped perimeter with substantially constant thickness, as shown in FIG. 5. The central portion 12 is provided with a diametric spacer 37, suitable to give stiffness to the central portion 12 between the two blades 16.

With reference to FIG. 4 again, it should be noted that the central portion 12 may have adjacent first grooves 34 or a groove 34 may laterally delimit a second groove 32 so as to maximize the probability that the fracture of the central portion 12 is brittle and that the hitting projectiles fracture it in very small fragments, thus completely freeing the witness cap 20.

With particular reference to FIG. 2, the height of the cylindrical annular portion 12 is slightly smaller than the height of the witness cap 20.

The use of the target 1 described above can be easily understood from the description above and does not require further explanations. However, it should be useful to specify that the presence of each first and second groove 34 and 32 represents a privileged crack nucleation point for the helical body 10, allowing to facilitate the fracture thereof (of the helical body 10) and therefore allowing the witness cap 20 to follow its trajectory separately from the helical body 10 towards the fenced area in front of the marked space with the shooting stand, so that the shot is considered valid according to the "electrocibles" rules. The profile of the annular portion 12 of FIG. 5 is undulating and has cylindrical portions 38 arranged between two grooves 32 and marked by at least one triangular notch in the respective outer face 122, and in particular each notch is constituted by a groove 34.

Lastly, it is clearly apparent that variants and modifications can be done to the target 1 described and illustrated herein without however departing from the protective scope of the present invention.

Figure 6:
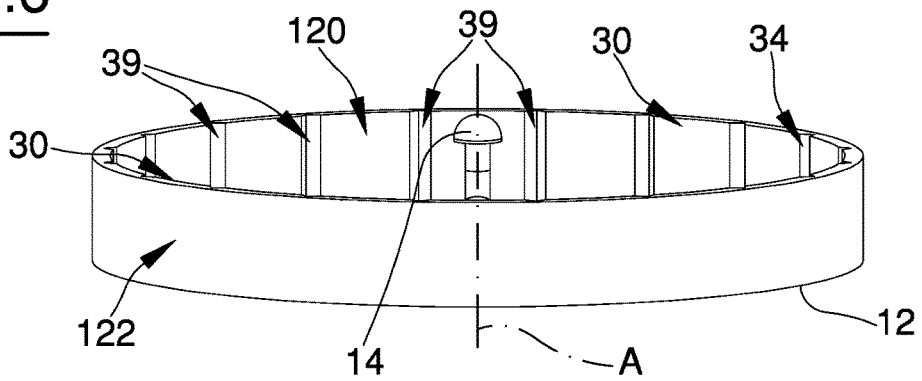
FIG. 6 is a schematic perspective view of a variant of a detail of FIG. 1, with some parts removed for the sake of clarity.

For instance, with reference to FIG. 6, the annular portion 12 may be cylindrical outside and grooved inside, with grooves 39 provided only in the inner face 120.

Figure 7:
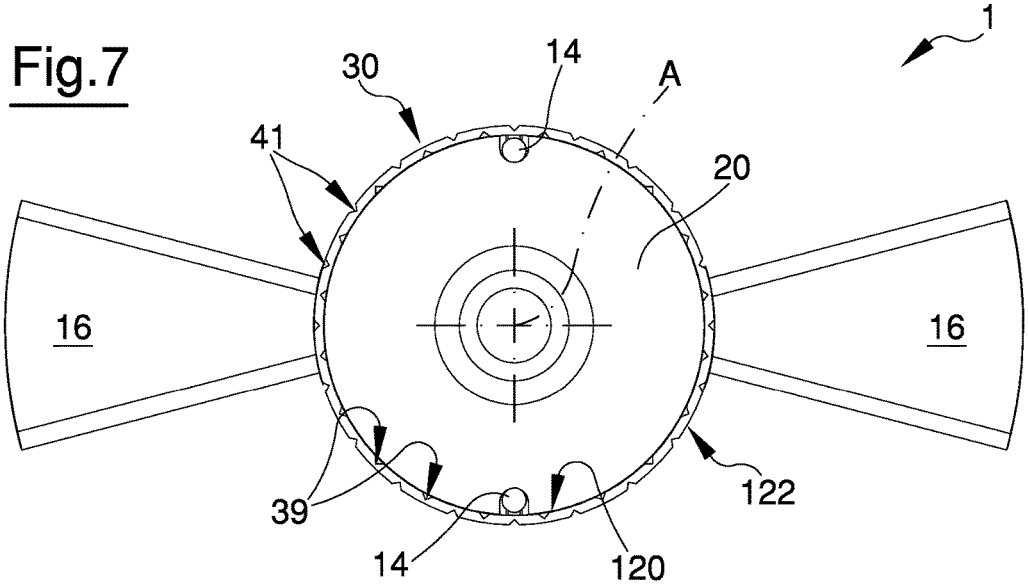
FIG. 7 is a plan view of a variant of FIG. 1.
Figure 8:
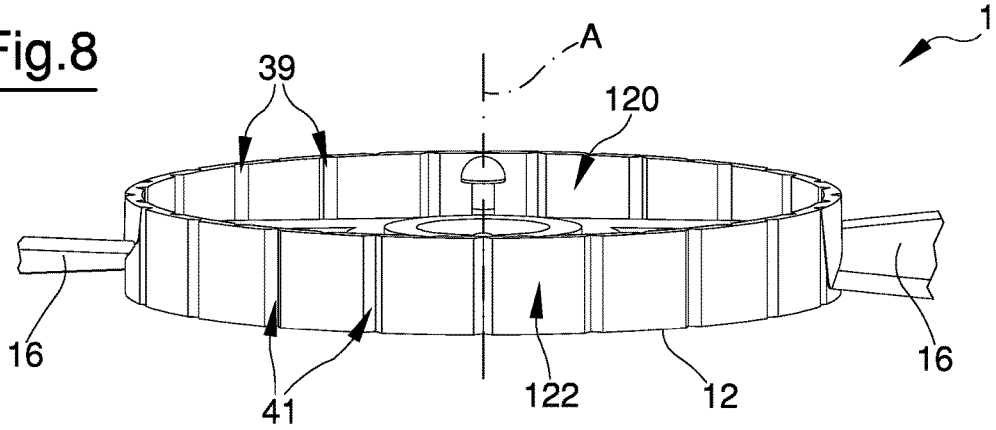
FIG. 8 is a schematic perspective view of FIG. 7, in enlarged scale and with some parts removed for the sake of clarity.

On the other hand, with reference to FIGS. 7 and 8, the annular portion 12 may be cylindrical outside and grooved inside with triangular grooves 39 and 41 respectively provided in the inner face 120 and in the outer face 122, and these grooves 39 and 41 may be alternate so that the profile of the annular portion 12 is substantially undulating.

Figure 9:
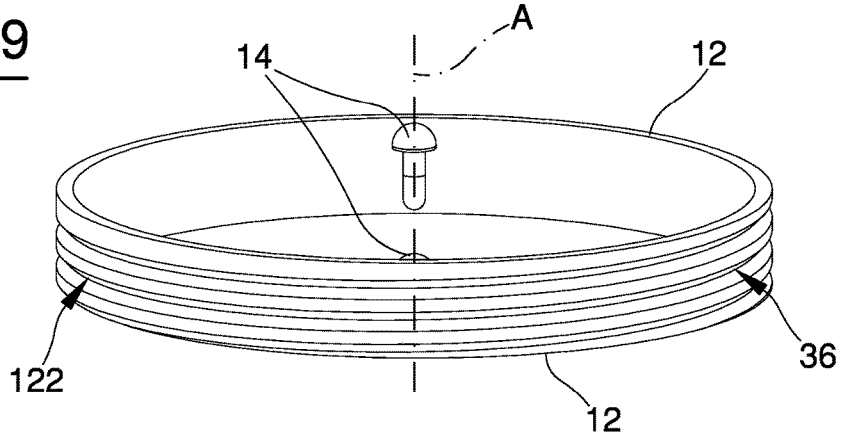
FIG. 9 is a schematic perspective view of a further variant of a detail of FIG. 1, with some parts removed for the sake of clarity.

Moreover, as shown in FIG. 9, the target 1 may be modified so that the annular portion 12 has at least one circumferential third groove 36, substantially shaped like a helix concentrically with the central axis A.

In view of the above description, it is clearly apparent that a target constructed like the target 1 illustrated above solves, in an easy and economical manner, the problem of facilitating the brittle fracture of the helical body, and in particular of the rigid annular portion 12 once this portion has been hit by a projectile and, therefore of facilitating the separation of the witness cap 20, made of flexible plastic, from the annular portion 12 of the target 1.

The invention claimed is:

1. Target (1) for helice target shooting comprising:

a helical body (10) comprising a cylindrical annular portion (12) that extends according to a central axis (A) and is provided, peripherally, with at least one pair of mushroom-shaped projections (14); and a witness cap (20) provided with at least one pair of peripheral seats (22);

wherein said helical body (10) and said witness cap (20) are dimensioned and configured to be snap-coupled together by engaging said at least one pair of mushroom-shaped projections (14) with said at least one pair of peripheral seats (22);

wherein said annular portion (12) is peripherally delimited by an inner face (120) and an outer face (122);

wherein said helical body (10) has crack nucleation means (30) suitable to facilitate the brittle fracture of said annular portion (12), in use, following at least one shot, thereby resulting in a breakage of said helical body (10) being sufficient to free said witness cap (20) from said helical body (10); wherein said breakage of said helical body (10) results in a destruction thereof such that said helical body (10) is configured for a single use and cannot be re-used after being broken.

2. Target according to claim 1, characterized in that said crack nucleation means (30) comprises at least one first groove (32) provided in said annular portion (12) and aligned with said central axis (A).

3. Target according to claim 2, characterized in that said annular portion (12) comprises a plurality of said first grooves (32) uniformly distributed around said central axis (A).

4. Target according to claim 3, characterized in that each said first groove (32) is provided in said outer face (122) and is delimited by a substantially quadrilateral perimeter.

5. Target according to claim 4, characterized in that each said first groove (32) is delimited by a substantially trapezoidal profile.

6. Target according to claim 2, characterized in that said crack nucleation means (30) comprises at least one second groove (34) provided in said outer face (122) of said annular portion (12) and having a substantially triangular section.

7. Target according to claim 6, characterized in that said annular portion (12) has a substantially undulating profile with at least one cylindrical portion (38) arranged between said second grooves (32) and marked with at least one triangle-shaped notch (34) in said outer face (122).

8. Target according to claim 1, characterized in that said crack nucleation means (30) comprises at least one inner face groove (39) and at least one outer face groove (41).

9. Target according to claim 1, characterized in that said crack nucleation means (30) comprises at least one circumferential groove (36) provided in said outer face (122) of said annular portion (12).

10. Target according to claim 9, characterized in that each said at least one circumferential groove (36) is helical and coaxial to said central axis (A).

* * * * *